US008269421B2

(12) United States Patent
Vail

(10) Patent No.: US 8,269,421 B2
(45) Date of Patent: Sep. 18, 2012

(54) LIGHTING CONTROLLERS

(75) Inventor: David Vail, London (GB)

(73) Assignee: Cambridge Semiconductor Limited, Cambridge (GB)

( * ) Notice: Subject to any disclaimer, the term of this patent is extended or adjusted under 35 U.S.C. 154(b) by 354 days.

(21) Appl. No.: 12/670,940

(22) PCT Filed: Aug. 21, 2008

(86) PCT No.: PCT/GB2008/050728

§ 371 (c)(1),
(2), (4) Date: Jan. 27, 2010

(87) PCT Pub. No.: WO2009/027727

PCT Pub. Date: Mar. 5, 2009

(65) Prior Publication Data

US 2010/0188008 A1 Jul. 29, 2010

(30) Foreign Application Priority Data

Aug. 29, 2007 (GB) ..... 0716676.2

(51) Int. Cl.
*H05B 37/00* (2006.01)

(52) U.S. Cl. ..... 315/224; 315/307; 315/DIG. 7

(58) Field of Classification Search ..... 315/291, 315/224, 209 R, 307, DIG. 5, DIG. 7
See application file for complete search history.

(56) References Cited

U.S. PATENT DOCUMENTS 5,021,716 A 6/1991 Lesea
5,063,490 A * 11/1991 Maehara et al. ..... 363/37
6,225,753 B1 5/2001 Lee
2005/0062433 A1* 3/2005 Ongaro ..... 315/209 PZ
2006/0238138 A1* 10/2006 Quazi ..... 315/247
2007/0228994 A1* 10/2007 Hung et al. ..... 315/247
2008/0238334 A1* 10/2008 Green ..... 315/291

FOREIGN PATENT DOCUMENTS

EP 1 227 705 A 7/2002
GB 2 415 842 A 1/2006

OTHER PUBLICATIONS

International Search Report for corresponding PCT/GB2008/050728, completed Nov. 6, 2008 by Joao Carlos Silva of the EPO.
British Search Report for GB0716676.2, completed Jan. 2, 2008 by Peter Keefe.

* cited by examiner

*Primary Examiner* — David Hung Vu

(57) ABSTRACT

This invention generally relates to lighting controller, more particularly to electronic ballast circuits, sometimes referred to as electronic control gears (ECG) or gas discharge lamps. An electronic ballast for a gas discharge lamp, the electronic ballast comprising: a power input circuit to provide a dc voltage supply; a SEPIC converter having a converter input coupled to said dc voltage supply and having a dc voltage output; and a push-pull output stage coupled to said dc voltage output to provide an ac voltage for driving said lamp, said push-pull output stage comprising a pair of inductive elements each having a first connection to one another and to said dc voltage output and a second connection to a respective switch.

10 Claims, 10 Drawing Sheets

LIGHTING CONTROLLERS

FIELD OF THE INVENTION

This invention generally relates to lighting controllers, more particularly to electronic ballast circuits, sometimes referred to as electronic control gears (ECG) for gas discharge lamps.

BACKGROUND TO THE INVENTION

The use of a SEPIC (Single-Ended Primary Inductance Converter) converter a fluorescent lamp ballast circuit is described in "SEPIC converter to perform power factor correction in a ballast for fluorescent lamps", O. Busse, S. Mayer, B. Schemmel, A. Storm (Osram GmbH), IEEE Reference 01518852. This describes a standard circuit of a ballast for fluorescent lamps comprising a boost converter followed by a half bridge, one of the disadvantages of the boost converter being that the dc output voltage is always greater than the dc input voltage. The paper describes the use of a SEPIC converter which enables the dc output voltage driving the half bridge to be greater or less than the input voltage thus providing increased flexibility. However this arrangement is relatively complex.

An alternative topology is described in "A high-power-factor electronic ballast using a flyback push-pull integrated converter", R. N. do Prado, S. A. Bonaldo, IEEE Transactions on Industrial Electronics, Vol. 46, No. 4, August 1999, IEEE reference 00778245. However this configuration has the disadvantage that, because of the flyback configuration, the input current waveform is discontinuous and hence the conducted emissions are high.

Another paper, "A practical comparison among high-power-factor electronic ballasts with similar ideas", A. R. Seidel, F. E. Bisogno, T. B. Marchasan, and R. N. do Prado, IEEE Transactions on Industry Applications, Vol. 41, No. 6, November/December 2005, IEEE Reference 01542311, compares topologies including a boost half-bridge, a flyback half-bridge, a boost push-pull, and a flyback push-pull, recommending the flyback push-pull. Further background prior art can be found in U.S. Pat. No. 6,741,040, U.S. Pat. No. 6,690,122, EP 1 209 954A, GB 2,415,842A, U.S. Pat. No. 6,225,753, and "Coupled inductor design", L. Dixon, UNITRODE Power Supply Design Seminar Manual SEM-900, Topic 8.

The field of lighting controllers continues to provide a need for lower cost, higher efficiency design.

SUMMARY OF THE INVENTION

According to a first aspect of the invention there is therefore provided an electronic ballast for a gas discharge lamp, the electronic ballast comprising: a power input circuit to provide a dc voltage supply; a SEPIC converter having a converter input coupled to said dc voltage supply and having a dc voltage output; and a push-pull output stage coupled to said dc voltage output to provide an ac voltage for driving said lamp, said push-pull output stage comprising a pair of inductive elements each having a first connection to one another and to said dc voltage output and a second connection to a respective switch.

In embodiments the above-described arrangement enables a simple, low-cost design with a single high-voltage switching device whilst at the same time providing a high power factor and, in embodiments, a substantially continuous input current. Thus in some particularly preferred embodiments the SEPIC converter includes an active switch which also serves as one of the switches for the pair of inductive elements of the push-pull output stage. In some embodiments the other of the switches for the pair of inductive elements is provided by a passive element, more particularly a diode; in other embodiments a second active switch, preferably also shared with the SEPIC converter, is employed. This latter arrangement facilitates variation of the duty cycle of the SEPIC converter above 0.5, for example substantially over the range 0 to 1, enabling the dc output voltage of the SEPIC conductor to be greater or less that the dc output voltage. In embodiments the active switch comprises the transistor; in some particularly preferred embodiments a bipolar transistor although a MOS switching device may also be employed.

In embodiments the active switch of the SEPIC converter is coupled by a rectifier to one of the pair of inductive elements, to restrict current flow from a switched node of the SEPIC converter directly to the push-pull output stage inductors. In some particularly preferred embodiments a further rectifier is included between the active switch of the SEPIC converter and a coupling capacitor (in series between the dc input and the dc output of the SEPIC converter), to restrict current flow back from the push-pull output stage to the switched node and then on through the coupling capacitor.

In some preferred embodiments to reduce electromagnetic interference (EMI), sometimes referred to as conducted emissions, the two inductors of the SEPIC converter share a common core and are configured to steer ripple current from an input, series conductor to an output, parallel inductor. Broadly speaking this can be achieved by providing an air gap in the common core and winding the parallel inductor around the core over the air gap and the series inductor over the parallel inductor so that the series inductor couples less to the magnetic field "escaping" at the air gap. This ripple reduction is based on the recognition that a significant source of noise derives from high frequency ripple current drawn from the main supply by switching of the active device.

Embodiments of the electronic ballast include a controller to drive the active switch, the controller having a variable frequency so that one frequency may be employed to strike the discharge lamp and a second to run the discharge lamp once lit. Preferably the controller is also able to adjust a duty cycle of the drive to the active switch and hence vary the output voltage of the SEPIC converter and the brightness of the gas discharge (fluorescent) lamp.

Embodiments of the ballast are suitable for driving a fluorescent lamp with a pair of lamp filaments, one at either end. Preferably these are heated initially to emit electrons to strike the lamp by passing a current through the filaments for a period of order 0.5 to 2 seconds. This may be achieved by employing a lamp circuit comprising a series inductor coupled between a first ac voltage output from the push-pull output stage and a first of the lamp filaments, a series capacitor coupled between a second ac voltage output of the push-pull output stage and a second of the lamp filaments, and a parallel capacitor across the lamp filaments. In this way by operating the controller at a frequency not equal to (in particular above, for example about 80 KHz) a resonant frequency (for example 50 KHz) of the series inductor and parallel capacitor a relatively large preheating current flows through the filaments. Reducing the frequency towards resonance increases the voltage across the lamp and causes the lamp to strike (at resonance the impedance of the series inductance and parallel capacitance effectively cancel out, providing a high voltage across the lamp). Once the lamp has struck it behaves as a low resistance between the filaments. If the frequency is then increased the impedance of the choke in the lamp current increases, reducing the voltage across the lamp and dimming the lamp.

The skilled person will appreciate that a large number of different configurations may be employed for coupling the push-pull output stage to the lamp (or to multiple lamps), including single and multiple transformer couplings, tappings on the pair of inductive elements and the like. The skilled person will understand that the pair of inductive elements may comprise a single inductor with a centre tap.

In some preferred embodiments the electronic ballast is configured for mains operation and includes a circuit to rectify an input mains voltage to generate the dc supply to the SEPIC converter. However in other applications this dc supply may be provided from a battery, for example using an inverter.

In another aspect the invention provides an electronic ballast for a gas discharge lamp, comprising: a first dc-to-dc switching power supply stage having a dc voltage input, a dc voltage output, and a storage capacitor coupled to said dc voltage output; a second dc-to-ac switching power supply stage having a dc voltage input coupled to said dc voltage output of said dc-to-dc switching power supply stage and an ac voltage output for driving said lamp; wherein said electronic ballast includes a single controlled active switch shared between said dc-to-dc switching power supply stage and said dc-to-ac switching power supply stage; and wherein said first dc-to-dc switching power supply stage includes a coupling capacitor coupled in series between said dc voltage input of said dc-to-dc switching power supply stage and said storage capacitor, said coupling capacitor having a capacitance of less than half a capacitance of said storage capacitor.

The low value of the coupling capacitor relative to the storage (output) capacitor helps to reduce a surge in input current (which stresses the components) when the lamp is first switched on. Preferably the capacitance of the coupling capacitor is less than 1/10 that of the storage capacitor.

In some preferred embodiments the controllable active switch has a control terminal (for example a gate or base terminal of a MOS or bipolar switching transistor) which is configured for ground-referenced control. Thus where the switching device comprises a transistor one terminal of the transistor, for example an emitter or source terminal, is at or close to ground potential. This facilitates driving the active switch.

In embodiments the dc-to-dc switching stage comprises a SEPIC converter with a dc output to a push-pull stage driving a lamp circuit and lamp. As we describe later, the push-pull stage and the SEPIC converter may share a common controllable switch, thus enabling the construction of a single switch converter; in embodiments the switch may be ground-referenced. Further, the SEPIC converter may comprise an input to which is coupled a series inductor, an (the) active switch being connected across this. At the active switch/inductor node a series coupling capacitor delivers power to a parallel inductor (connected between the far side of the coupling capacitor from the input and the second input connection, generally ground) and then a series diode provides rectified power to an output (storage) capacitor connected across the output of the SEPIC converter (one connection to the diode, one to a common input-output connection, generally ground). A boost converter can, however, suffer from a current in-rush problem and although this can be addressed by incorporating a series resistive device into the circuit this is inefficient. Therefore in some preferred embodiments we employ a relatively small coupling capacitor in series with a relatively larger output capacitor which, in the context of the above-described arrangement, addresses this problem. In embodiments the push-pull stage may comprise a see-saw arrangement with switched, opposite-polarity inductors.

In a still further aspect the invention provides a lighting controller for a gas discharge lamp, the lighting controller comprising: a mains power supply input; a mains rectifier circuit coupled to said mains power supply input and having a rectified mains voltage output; a first inductor having an input side coupled to said rectified mains voltage output and an output side; a controllable switch coupled in parallel between said output side of said first inductor and a ground connection of said rectified mains voltage output; a coupling capacitor having an input side coupled to said output side of said first inductor and having an output side; a second inductor coupled in parallel between said output side of said coupling capacitor and said ground connection; a first rectifier coupled between said output side of said coupling capacitor and a storage capacitor to provide a dc voltage supply; and a pair of inductive elements each having a first connection coupled to said dc voltage supply and each having a second connection coupled to a respective rectifier; and an ac output circuit to drive said lamp coupled to said pair of inductive elements; and wherein a first of said respective rectifiers is coupled to said ground connection and a second of said respective rectifiers is coupled to said controllable switch.

Preferably the controller includes a further rectifier coupled between the controllable switch and the coupling capacitor, as described above. Preferably a variable frequency controller is included for controlling the switch. In some particularly preferred embodiments the controllable switch comprises a bipolar transistor.

In a still further aspect the invention provides a lighting controller for a gas discharge lamp, the lighting controller comprising: a mains power supply input; a mains rectifier circuit coupled to said mains power supply input and having a rectified mains voltage output; a first inductor having an input side coupled to said rectified mains voltage output and an output side; a controllable switch coupled in parallel between said output side of said first inductor and a ground connection of said rectified mains voltage output; a coupling capacitor having an input side coupled to said output side of said first inductor and having an output side; a second inductor coupled in parallel between said output side of said coupling capacitor and said ground connection; a first rectifier coupled between said output side of said coupling capacitor and a storage capacitor to provide a dc voltage supply; a half-bridge stage coupled to said dc voltage supply to provide an ac output for driving said lamp; and at least one controller to control said controllable switch and said half-bridge stage; and wherein said at least one controller is configured to vary one or both of a frequency and a duty cycle of a drive to said half-bridge stage to control a brightness of said lamp.

Separate controllers or a single controller may be employed to control the controllable switch and half bridge stage. In embodiments the at least one controller is further configured to vary one or both of a frequency and a duty cycle of a drive to said controllable switch and thus 1, 2, 3 or 4 parameter control may be employed.

In embodiments varying both of the frequency and duty cycle of the (oscillatory) drive to the half bridge and/or to the controllable switch in the above-described configurations enables dimming of the light to less than 5%, 2% or 1% of a rated power level.

BRIEF DESCRIPTION OF THE DRAWINGS

These and other aspects of the invention will now be further described, by way of example only, with reference to the accompanying figures in which.

DETAILED DESCRIPTION OF PREFERRED EMBODIMENTS

Figure 1A:
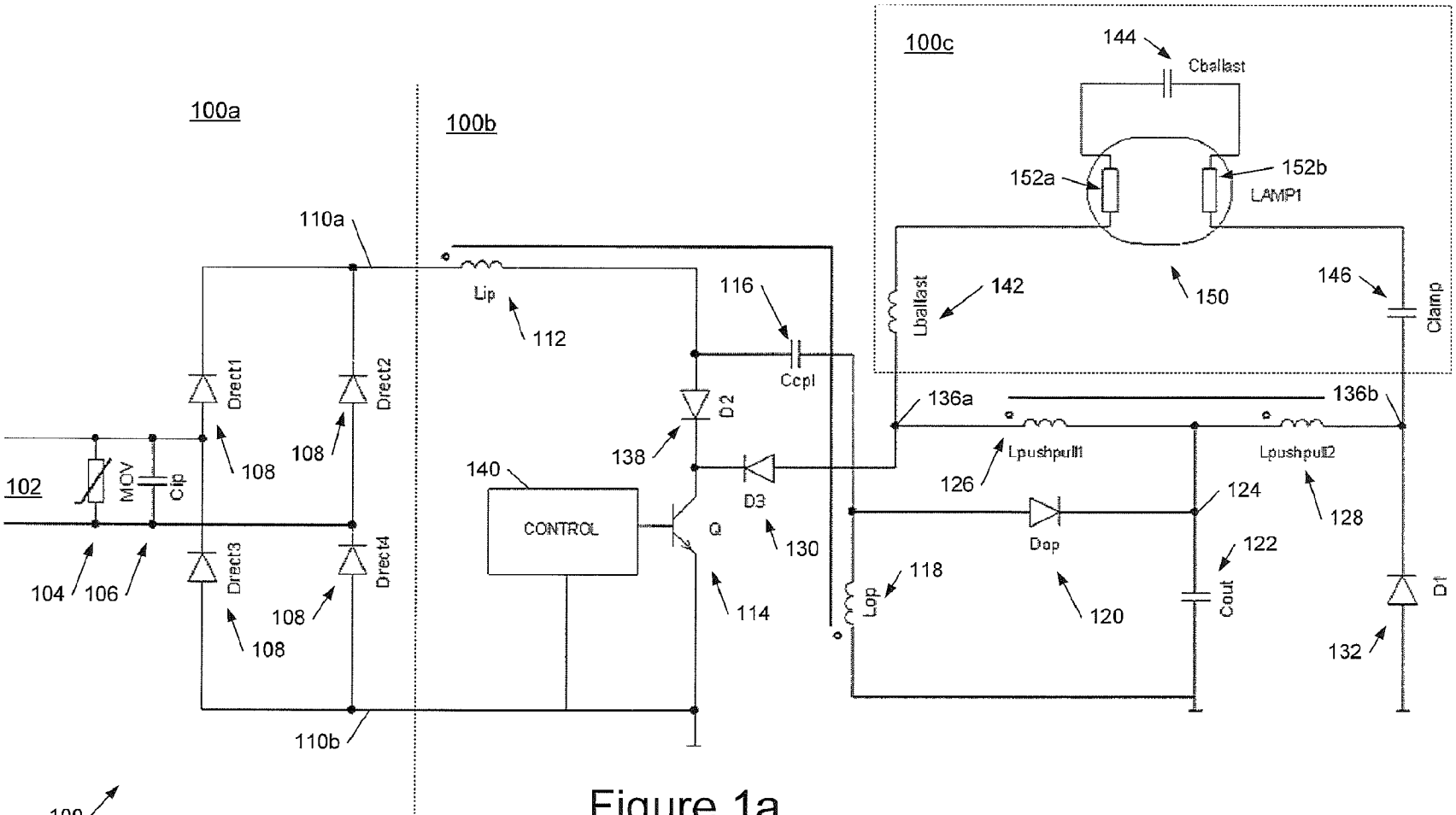
FIGS. 1*a* to 1*e* show, respectively, a first embodiment of a lighting controller (electronic ballast) according to an aspect of the invention, switch voltage, output voltage and rectified input voltage waveforms for the circuit of FIG. 1*a*, waveforms illustrating the effect of ripple current steering over a 50 Hz mains cycle, waveforms illustrating lamp current and voltage for the circuit of FIG. 1*a*, and a variant of the first embodiment employing two active switches.

Referring to FIG. 1*a*, this shows a fluorescent lamp lighting controller or electronic ballast 100 comprising an integrated SEPIC converter and push-pull output topology, according to an embodiment of the invention. The controller can be divided into three main sections, a mains input stage 100*a*, a combined SEPIC and push-pull stage 100*b*, and a lamp circuit 100*c*.

The mains input stage 100*a* comprises a mains input 102 across which are preferably connected a voltage dependent resistor (metal oxide varistor, MOV) 104, and an input filter capacitor Cip 106 providing ac mains to a bridge rectifier comprising diodes 108. This input stage provides a dc input voltage on line 110*a* referenced to ground 110*b*, to SEPIC-pushpull stage 100*b*.

In stage 100*b* the SEPIC converter comprises the following components: an input inductor Lip 112, to which is coupled an active switch to ground, transistor Q 114, a coupling capacitor Ccpl 116 coupling the switched node to an output inductor Lop 118 connected, via the coupling capacitor, between the switched node and ground. An output diode Dop 120 extracts power from the output inductor node and delivers this to output storage capacitor Cout 122 which provides a dc output voltage on node 124. As illustrated, the input inductor Lip 112 and the output inductor Lop 118 may share a common core. In operation, broadly speaking when the switch 114 is on the current through Lip 112 ramps up linearly according to the effective inductance of Lip and Lop in parallel (current ramping in both these components), and when switch 114 is turned off both Lip and Lop deliver current through Dop to Cout. The power delivered is proportional to the square of the on time of switch 114. The duty cycle controls the dc output voltage at node 124.

The push-pull output stage comprises the following components: Lpushpull1 126, Lpushpull2 128, diode D3 130 and switch 114, and diode D1 132. The dc output voltage node of the SEPIC converter is coupled to a common connection of Lpushpull1 and Lpushpull2, and each of these push-pull inductors has a respective switch, for Lpushpull1 D3 and Q, for Lpushpull2 D1, each able to connect the other end of the respective push-pull inductor to ground. In operation, broadly speaking Lpushpull1 and L-push-pull2 operate as a seesaw about the centre node voltage Vout, each of Lpushpull1 and Lpushpull2 being alternately connected to ground. When Lpushpull1 is connected to ground the centre of the see-saw is at Vout and the switched terminal of Lpushpull2 (which is not connected to ground) is at 2Vout; when the switched terminal of Lpushpull2 is at ground the switched terminal of Lpushpull1 is not connected to ground and the voltage on this terminal is 2Vout thus an ac voltage is developed across nodes 136*a, b*, node 136*b* being at 2Vout when node 136*a* is at 0V and vice-versa. The skilled person will appreciate that diode D1 132 operates as a passive switch since it is either off (node 136*b* at twice Vout) or on (node 136*b* at substantially ground potential).

Figure 1B:
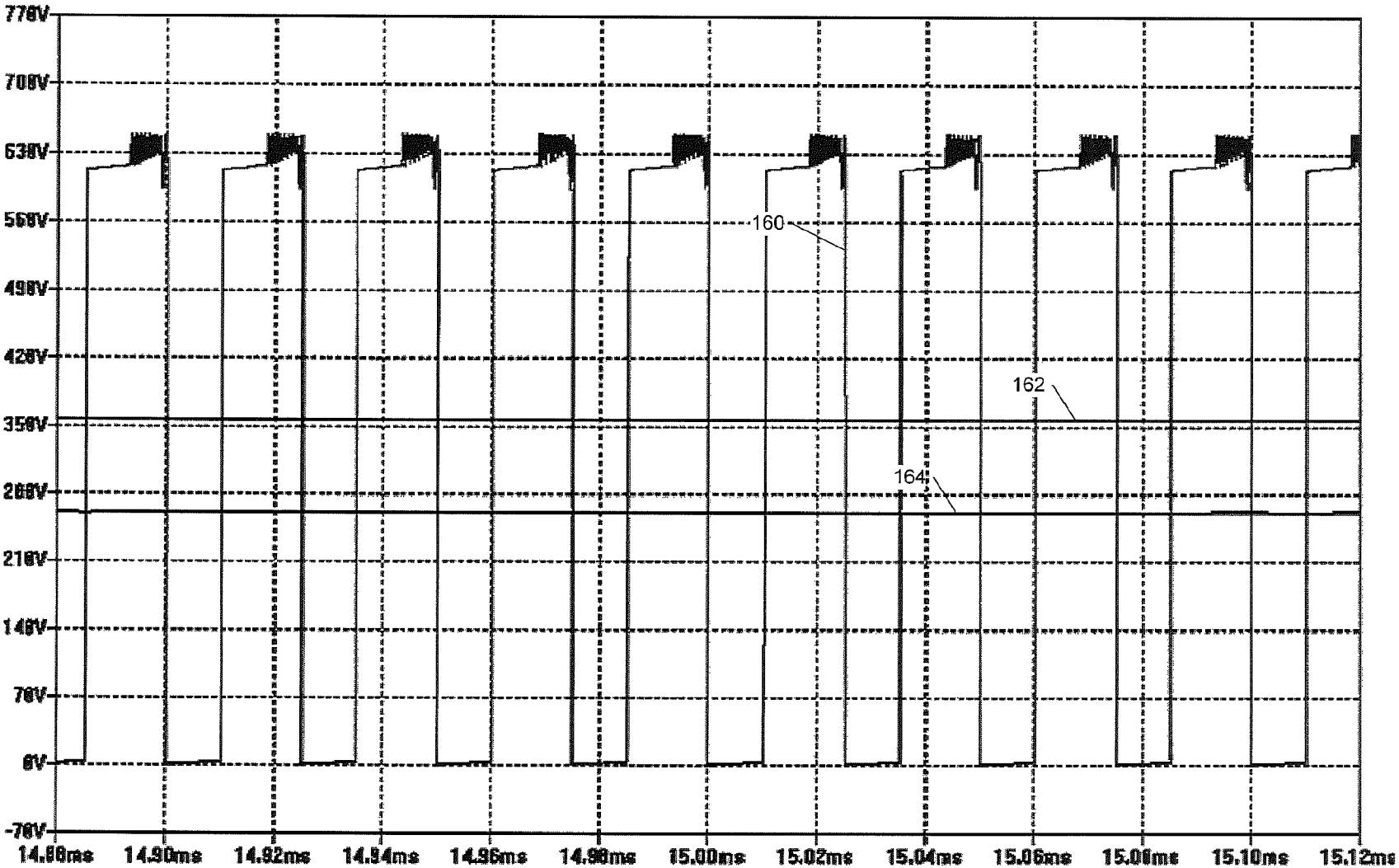
Figure 1C:
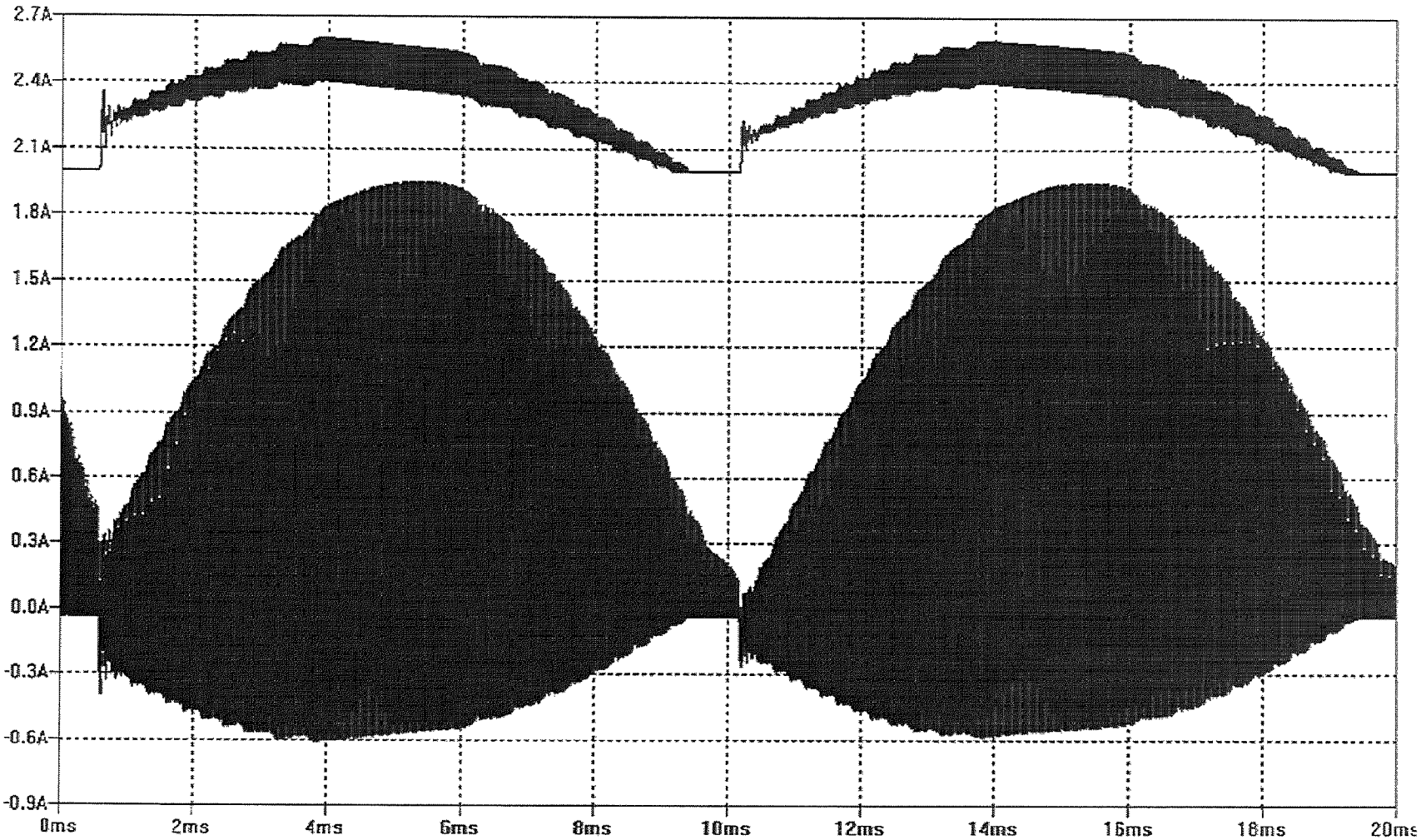
Figure 1D:
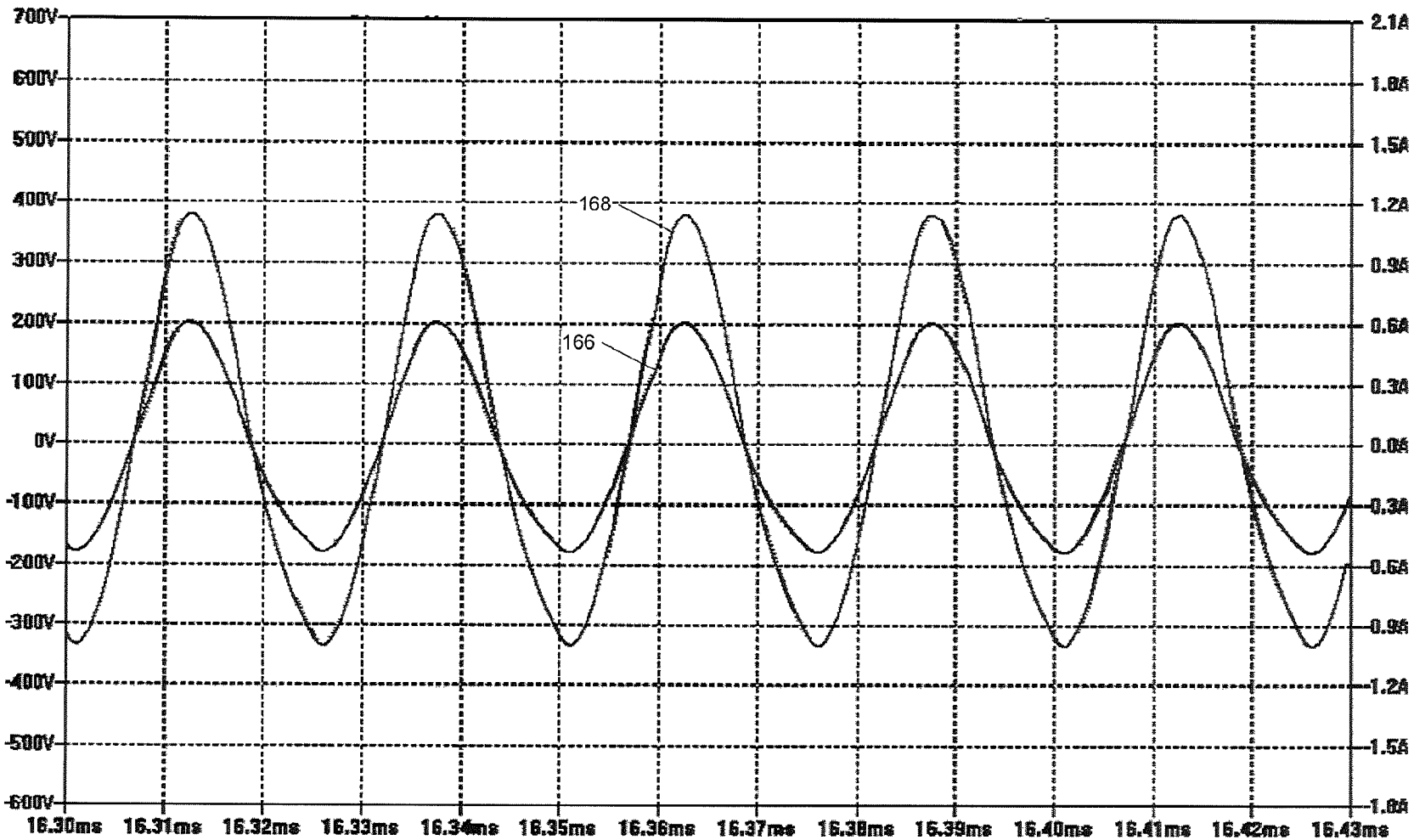
Figure 1E:
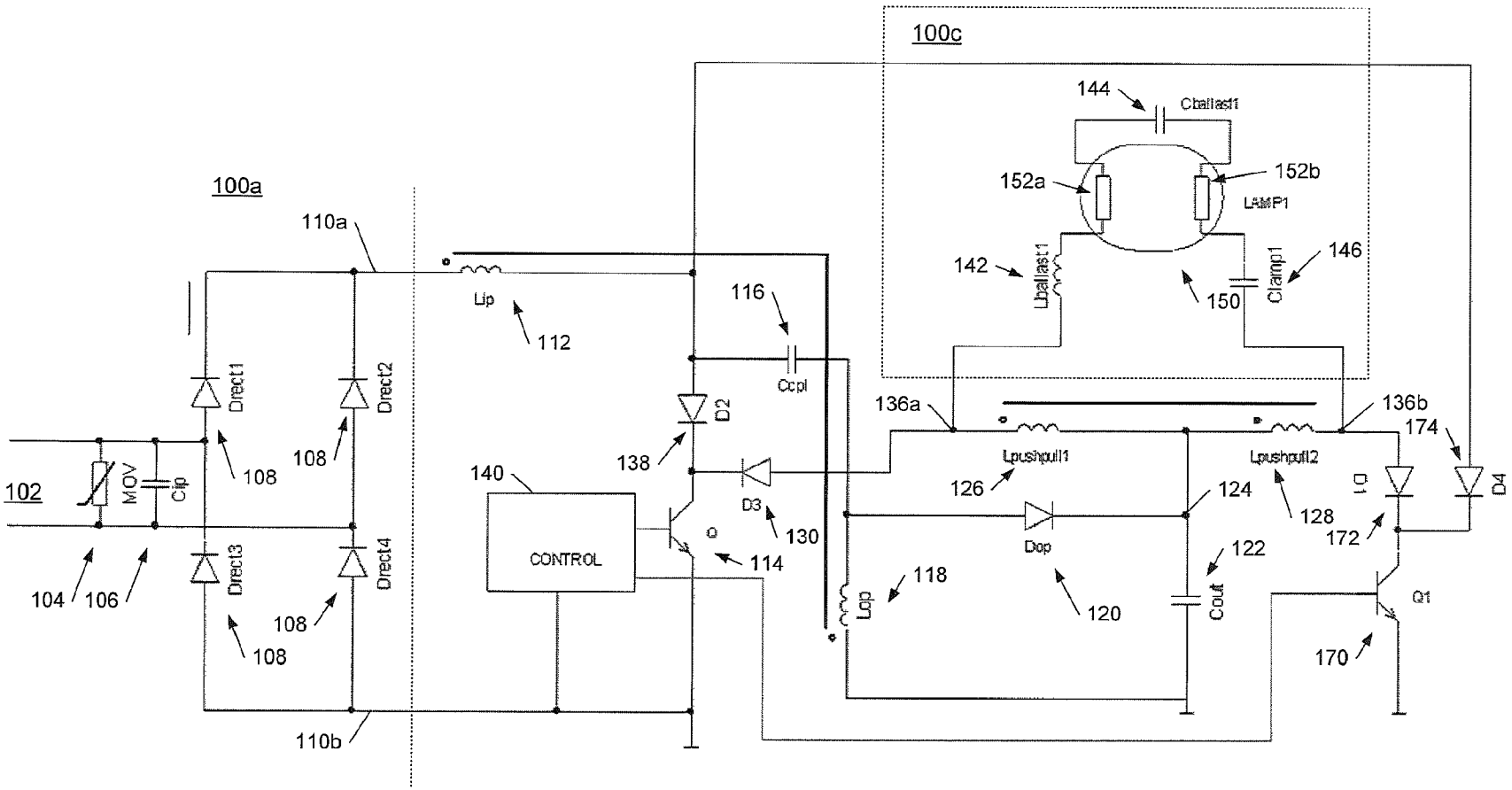

FIG. 1*e* shows a variant of the circuit of FIG. 1*a* including a second active switch 170 (again in this example a bipolar transistor) rather than the passive switch 132 of the FIG. 1*a* embodiment. This second active switch is coupled to Lpushpull2 128 by a diode 172, corresponding to diode 130 on the other half of the push-pull output stage. Likewise a further diode 174 couples the switched node (collector of transistor 170) to the input inductor 112, in a similar manner to diode 138 on the other side of the push-pull stage.

The arrangement of FIG. 1*e* has the advantage that SEPIC converter portion of the circuit is able to run at duty cycles of between 0 and 1, and thus the dc output voltage at node 124 maybe greater than or less than the dc input voltage on line 110*a*. By contrast the arrangement of FIG. 1*a* which includes a single active switch is substantially limited to a duty cycle of 0-0.5 if the push-pull inductors are balanced.

In the above circuits it can be seen that the active switching transistor 114 is shared between the SEPIC converter and the push-pull output stage. Preferably diode D2 138 is included to prevent current flow from node 136*a* back through coupling capacitor Ccpl 116. Although transistor 114 is shown as a bipolar transistor, a field effect transistor or other switching device may alternatively be employed.

In preferred embodiments Lip 112 and Lop 118 are coupled to steer ripple current caused by switching of transistor 114 to Lop 118. This can be achieved by winding Lip and Lop on a common core with a gap in the centre leg (the outer legs should be in close contact), winding Lop closest to the centre leg with the air gap and Lip over Lop; for more details reference may be made to "Coupled Inductor Design", Lloyd Dixon, S.L. U.P. 105 UNITRODE, 1993 (ibid).

The active switch 114 is controlled by a control circuit 140 comprising an oscillator, preferably with a variable frequency, and optionally with a variable duty cycle, for power (brightness) control. Preferably the oscillator has a frequency in the range 40 KHz to 100 KHz; optionally the control circuit 140 may include additional functions such as current sensing via a current sense resistor. Preferably the controller is configured to apply a frequency higher than a resonant frequency of lamp circuit 100*c* initially to warm the filament for a period, for example of order 1 second, to facilitate starting of the lamp, and then to reduce the frequency towards a resonant frequency of the lamp circuit 100*c* to start and operate the lamp. An example start frequency is approximately 80 KHz; an example operating frequency is approximately 50 KHz. For these frequencies typical component values are as follows: Cip 100 n, Lip 1500μ, Lop 1500μ, Ccpl 1000 n, Cout 47μ, Lpushpull1 10,000μ, Lpushpull2 10,000μ.

The lamp circuit 100*c* will be familiar to those skilled in the art; alternative lamp circuits may be employed with alternative lamps. In the illustrated example a fluorescent lamp 150 has two filaments 152*a, b* (each of typical resistance 10 ohms) and the lamp circuit comprises a ballast capacitor Cballast 144 linking one end of each filament, a ballast inductor Lballast 142 linking ac voltage node 136*a* with a second terminal of filament 152*a*, and (optional) lamp capacitor Clamp 146 linking ac voltage node 136*b* with a second terminal of filament 152*b*. Typically lamp 150 is filled with low pressure mercury vapour. Broadly speaking before the lamp is struck when above the resonant frequency the lamp circuit components form a potential divider across the ac voltage output of the push-pull stage and there is no very high voltage across the lamp, whereas at resonance the inductive and capacitive ballast impedances effectively cancel so that a high voltage is applied across lamp 150.

The circuit of FIG. 1*a* can be constructed at relatively low cost, employs a single, ground-referenced switch, can provide low ripple input current, and in embodiments has a low inrush current. In preferred embodiments the coupling capacitor Ccpl 116 is much less than the value of the storage capacitor Cout 122 and thus the series capacitance to ground is dominated by that of the coupling capacitance and is low, thus resulting in a low inrush current. Since the dc output voltage can be controlled the ballast input voltage the circuit can be employed for voltage dimming and, in embodiments, variable frequency control provides an additional control parameter allowing dimming by switch frequency control.

In more detail, in operation switch Q is driven with a duty cycle between 0 and 0.5, and a dc output voltage is generated across C10. When the switch Q turns on, the output voltage is applied across one half of the push-pull transformer 126, 128. When the switch turns off the collector voltage is driven high, the finish of inductor 128 is driven low and may be clamped by the diode D1. By coupling the lamp resonant circuit from the start of inductor 126 to the finish of inductor 128, an ac voltage supplies the lamp. The lamp voltage can be adjusted by the duty cycle and frequency applied to switch Q. The output voltage of the SEPIC stage, across Cout, can be adjusted by varying the duty cycle of the switch as with a stand-alone SEPIC converter. Windings Lip/Lop can be designed such that ripple current is steered away from the input and into Lop, thereby drawing a very low ripple current from the input supply. In order to start the lamp the switching frequency is swept from a high value to a lower value through the resonance formed by the ballast inductor Lballast, and capacitor Cballast.

Referring now to FIG. 1*b*, this shows waveforms illustrating the operation of the circuit of FIG. 1*a*. More particularly this shows a voltage waveform 160 at the switched node (collector of transistor Q) of switch 114, the rectified input voltage 162 on line 110*a*, and the output voltage 164 on node 124, for a presumed 230 volt ac mains supply. FIG. 1*c* shows the effect of ripple current steering over a 50 Hz mains cycle. The upper trace shows the ripple in the input inductor (offset by 2 amps for clarity), and the lower trace shows the ripple in the output inductor (Lop). FIG. 1*d* illustrates the lamp current 166 and lamp voltage 168 in the circuit of FIG. 1*a*.

Figure 2:
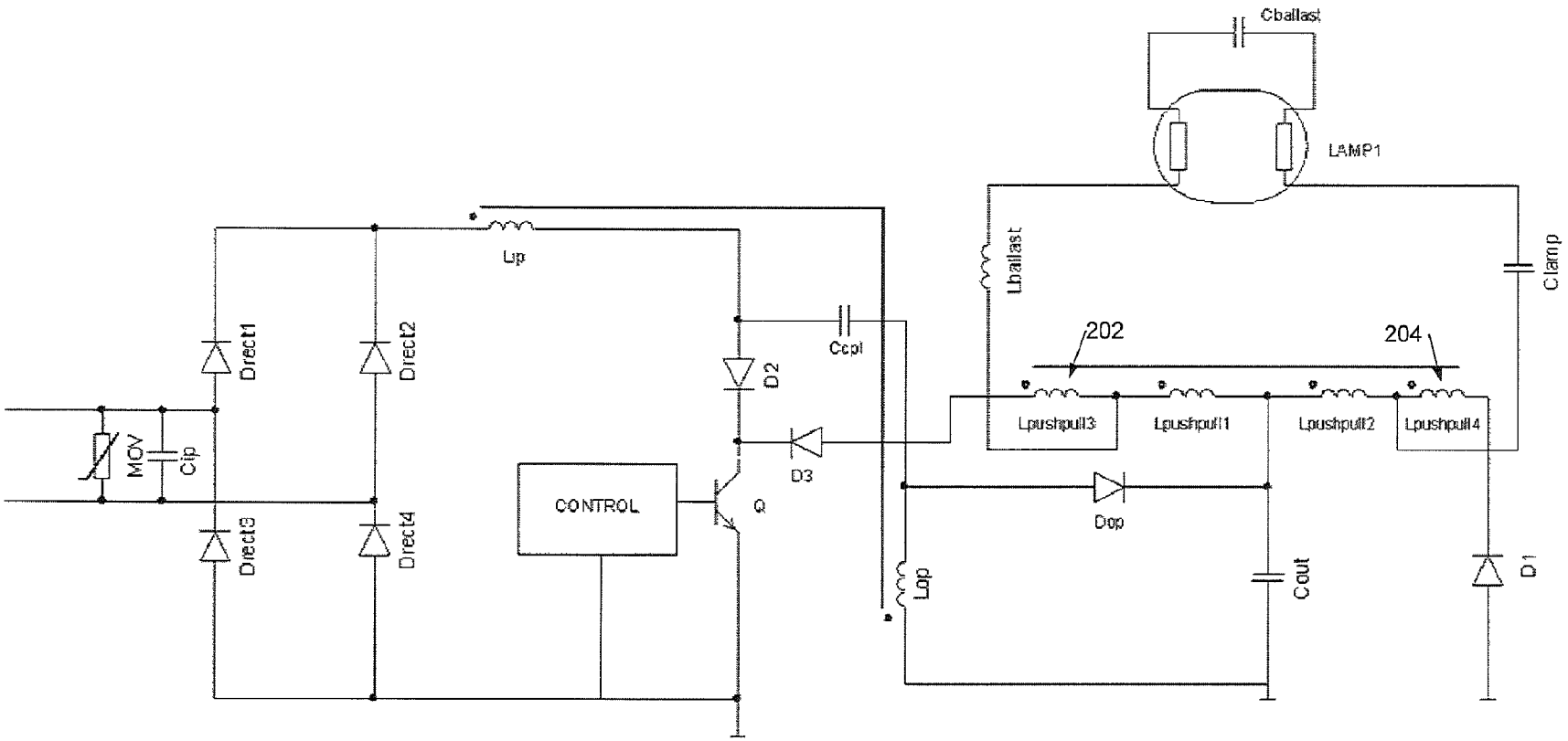
FIG. 2 shows a second embodiment of a lighting controller (electronic ballast) according to an aspect of the invention, with tapped transformer windings.

Referring now to FIG. 2, this shows a second embodiment of a lighting controller (electronic ballast) 200 illustrating a first variant of the arrangement of FIG. 1. In the circuit of FIG. 2 the push-pull output stage has an additional pair of push-pull inductors, Lpushpull3 202 and Lpushpull4 204. This arrangement effectively taps the push-pull inductors of FIG. 1*a* and may be used, for example, if the ac output voltage is undesirably high (although the output voltage is adjustable it is generally preferable to design a circuit so that the output voltage is broadly in the desired range). Providing push-pull output inductors with one or more additional taps increases the flexibility of the design.

Figure 3:
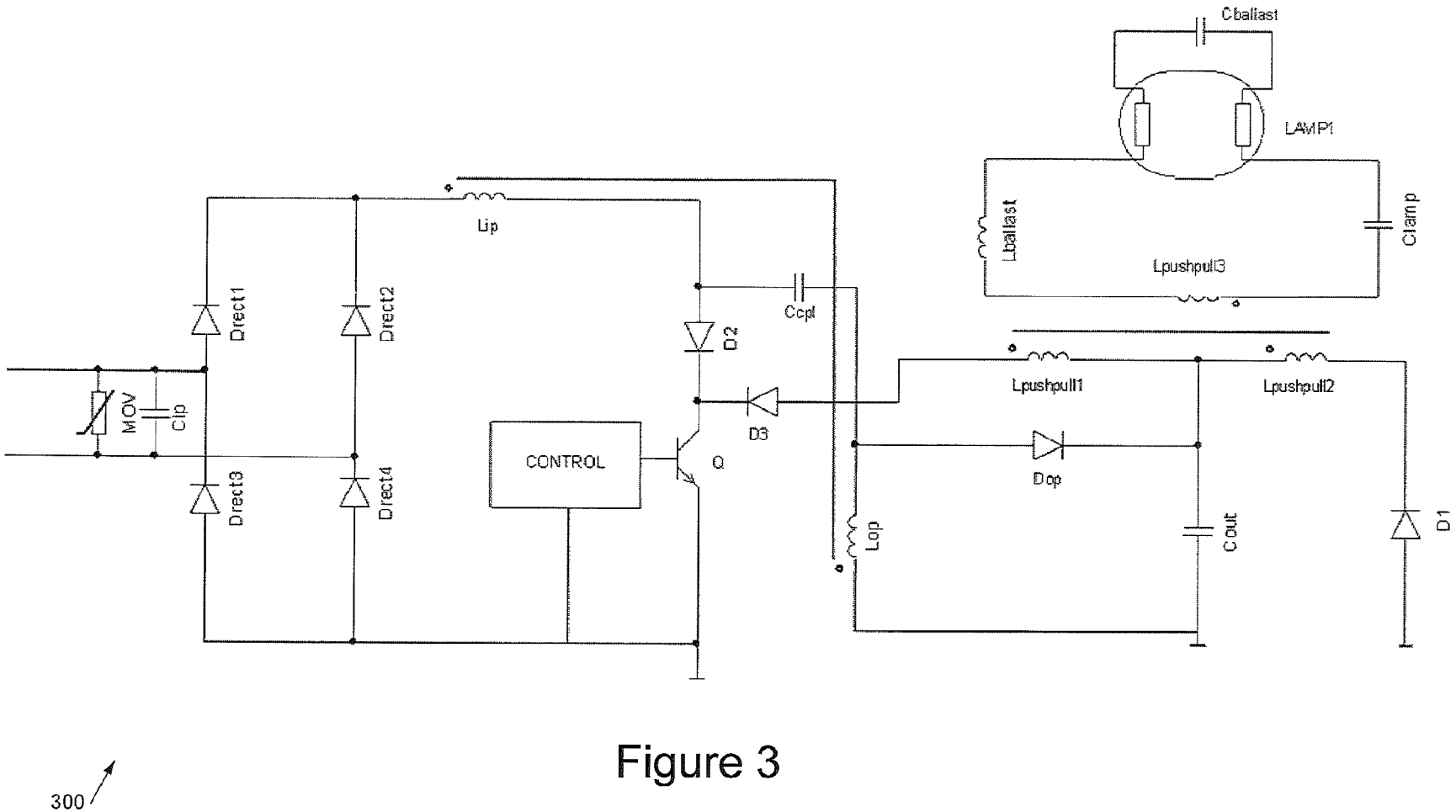
FIG. 3 shows a third embodiment of a lighting controller (electronic ballast) according to an aspect of the invention, employing a transformer secondary.

FIG. 3 shows a third embodiment 300 of electronic ballast in which the push-pull output stage employs a transformer secondary for coupling to the lamp, Lpushpull3.

Figure 4:
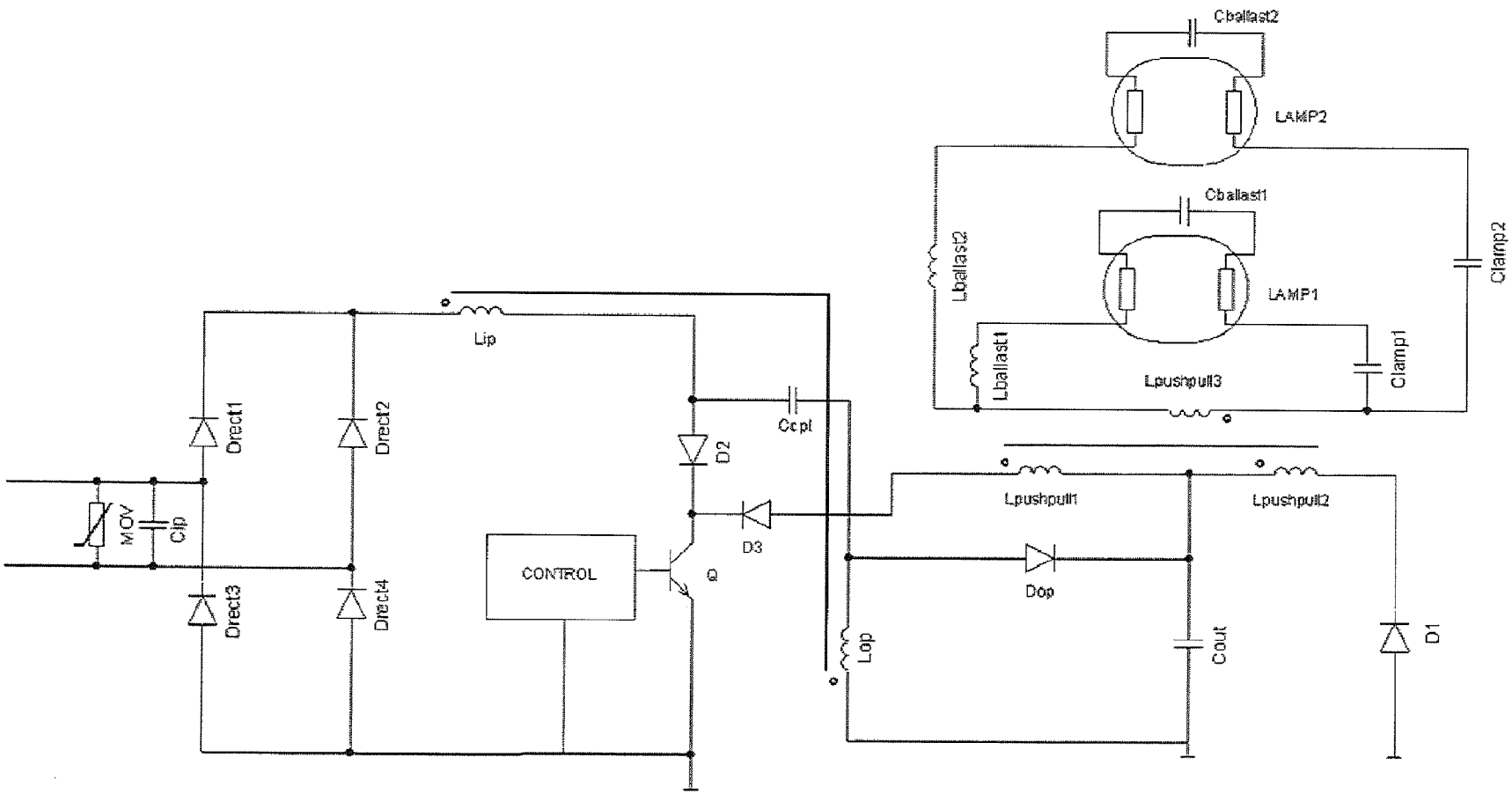
FIG. 4 shows a fourth embodiment of a lighting controller (electronic ballast) according to an aspect of the invention, illustrating an example of multiple lamps and multiple lamp resonant circuits.

FIG. 4 shows a fourth embodiment 400 of an electronic ballast including a transformer secondary as illustrated in FIG. 3, and configured to run multiple lamps in parallel through the use of multiple lamp resonant circuits.

Figure 5:
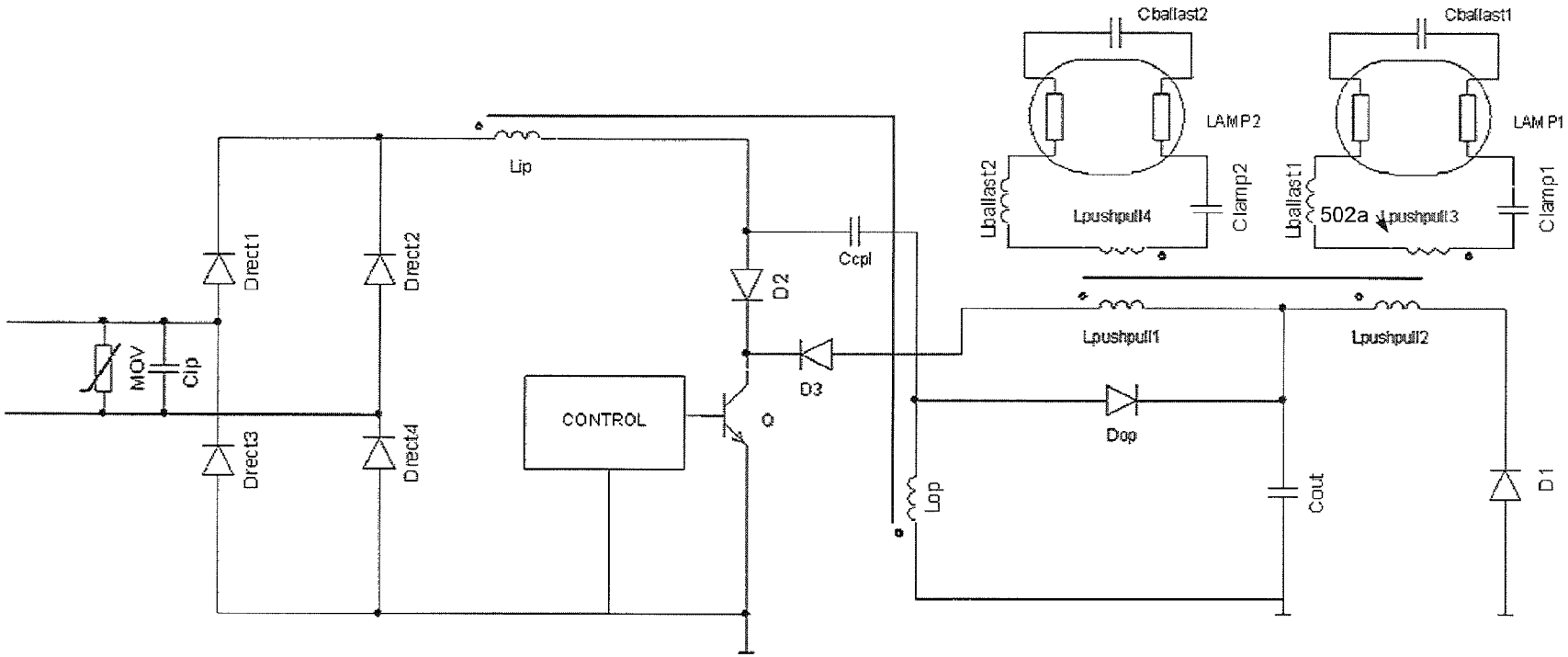
FIG. 5 shows a fifth embodiment of a lighting controller (electronic ballast) according to an aspect of the invention, illustrating an example of multiple transformer secondaries driving respective lamps and lamp resonant circuits.

FIG. 5 shows a further embodiment 500 of the lamp controller (electronic ballast) employing multiple transformer secondaries 502*a*, 502*b* each configured to drive one or more lamps. The skilled person will understand that the polarity of the secondary winding is not important in the arrangement of FIG. 3, 4 or 5.

Figure 6:
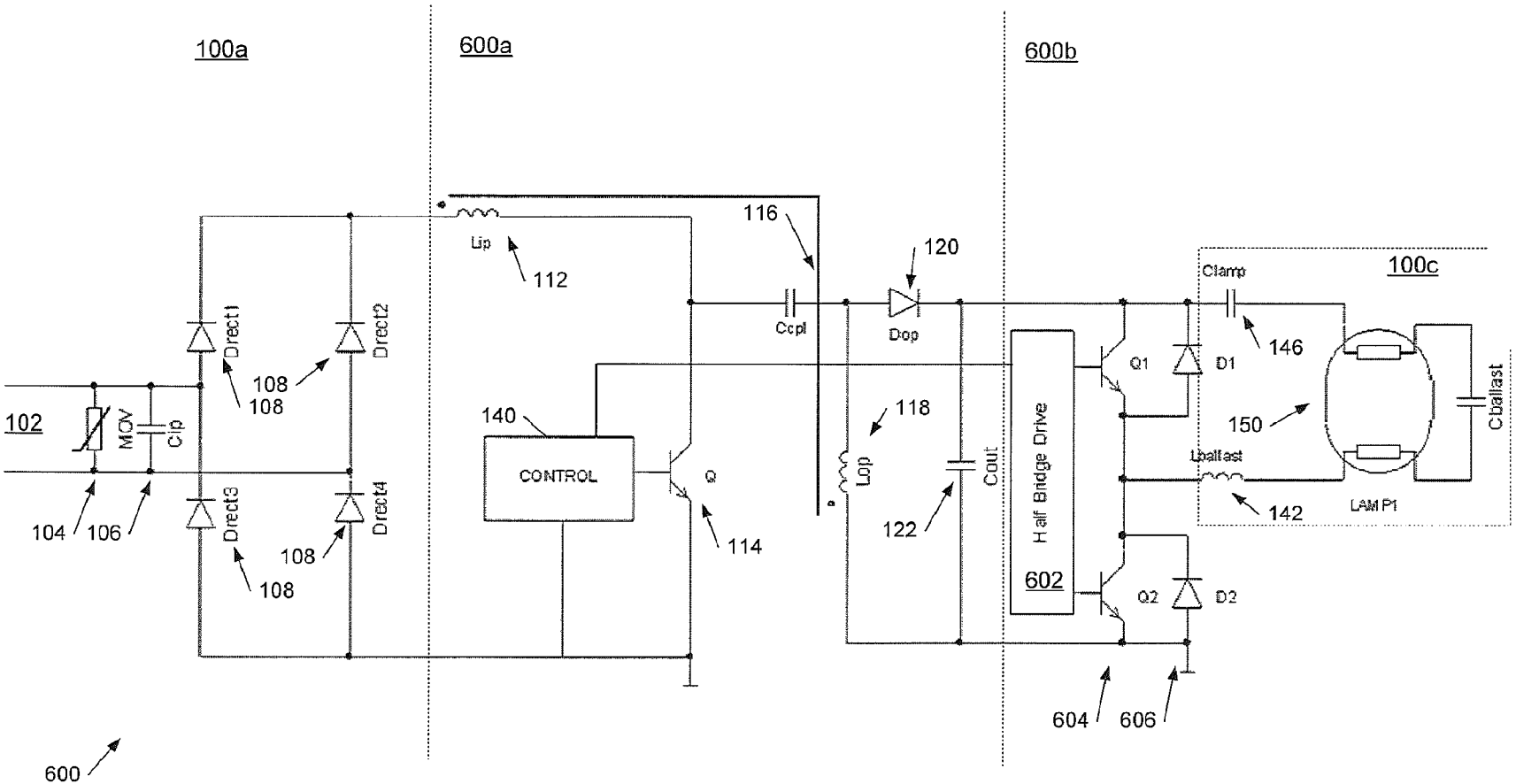
FIG. 6 shows an embodiment of a lighting controller (electronic ballast) according to a further aspect of the invention, illustrating a combined SEPIC and half bridge converter with four-parameter control.

Referring now to FIG. 6, this shows an alternative design for a lighting controller (electronic ballast) 600 which employs a half bridge output stage rather than using a push-pull topology. In the arrangement of FIG. 6 like elements to those of FIG. 1*a* are indicated by like reference numerals, and it will be appreciated that the mains rectification stage 100*a* and lamp circuit 100*c* correspond to those shown in FIG. 1*a*. However the arrangement of FIG. 6 employs a SEPIC converter 600*a* coupled to a half bridge output stage 600*b* to provide an ac voltage output to the lamp circuit 100*c*. The half bridge output stage comprises a half bridge driver 602, which may be synchronised with or combined with the SEPIC control circuit 140 driving a pair of half bridge transistors 604, as illustrated bipolar transistors each with a rectifier 606 connected across the collector and emitter terminals.

In operation switch Q is driven with a duty cycle between 0 and 0.5 and switches Q1 and Q2 are driven in complementary fashion with a duty cycle between 0 and 0.5. A DC output voltage is generated across Cout, and this can be controlled by switch Q to be above or below the input voltage. The lamp is driven by a resonant circuit excited by switches Q1/Q2 with a variable duty cycle and/or frequency.

It can be difficult to dim a fluorescent lamp to very low power levels (less than 1% of rated power) without flicker or other undesirable effects, by varying only one control parameter. However in the arrangement of FIG. 6 the lamp power, and therefore brightness, is controlled by varying two independent parameters of the drive to the half bridge stage, lamp voltage and lamp frequency. The lamp voltage can be varied as described above but by varying both lamp voltage and lamp frequency the electronic ballast can control the lamp to lower light levels than would otherwise be possible. Optionally one or both of the duty cycle and frequency of the SEPIC converter may also be controlled (independently of or in tandem with the drive of the bridge stage), to enable with further control over lamp brightness. In particular implementations of this circuit enable accurate dimming to very low power levels (<1% of rated power) with a low cost controller. Preferred implementations also start the lamp as previously described. Thus the cascaded SEPIC-half bridge ballast facilitates the control of both variable lamp voltage and variable lamp frequency as independent variables to optimise dimming of a fluorescent tube to power levels below 1% of rated power.

The skilled person will appreciate that control of the half bridge stage 600*b* may be achieved by a number of methods including, but not limited to, use of a high voltage driver, and/or controlling the reset time of the flux in a drive transformer. Referring to the circuit of FIG. 6, one of the transistors (Q1) has a high side driver and the other of the transistors (Q2) a low side driver and, as the skilled person will understand, the high side drive to transistor (Q1) may be provided in a number of different ways. For example rather than using a high voltage integrated circuit a transformer may be employed which saturates after a period, removing the drive to one of the transistors so that the drive flips to the other transistor; by making the transformer saturate faster (or slower) the drive frequency can be increased (or decreased).

As previously described the circuit may be modified to run one lamp, or multiple lamps. Additionally or alternatively a transformer may be added; this may have one or multiple secondaries each driving one or more lamps. The power switches may be of any suitable type including, but not limited to bipolar and/or MOS transistors.

Referring again now to the integrated SEPIC-pushpull converter the skilled person will appreciate that embodiments of this design provide a number of significant advantages in a single topology: the design uses a single, ground reference switch, thereby facilitating the use of a low cost control integrated circuit, and has inherently low inrush current, thereby removing the need for dissipative inrush limiting devices or complex circuitry to short such an inrush limiting device after start-up. Embodiments enable "zero ripple current steering" to minimise ripple currents drawn from the input, and in embodiments complex control strategies may be employed through variation of the operating frequency and duty cycle of the drive to the switching device. The design provides flexibility, in particular because the output voltage of the SEPIC stage can be controlled, and moreover the design can achieve a high power factor because the input is current-fed.

A number of variants of the arrangement have been illustrated including multiple resonant circuits, multiple secondaries, tapped primary windings and combinations of these. In embodiments of the described circuits lamp brightness is controlled by varying two independent parameters, lamp voltage and lamp frequency, thus enabling a very wide range of brightness control.

No doubt many other effective alternatives will occur to the skilled person. It will be understood that the invention is not limited to the described embodiments and encompasses modifications apparent to those skilled in the art lying within the spirit and scope of the claims appended hereto.

The invention claimed is:

1. An electronic ballast for a gas discharge lamp, comprising:

a first dc-to-dc switching power supply stage having a dc voltage input, a dc voltage output, and a storage capacitor coupled to said dc voltage output;

a second dc-to-ac switching power supply stage having a dc voltage input coupled to said dc voltage output of said dc-to-dc switching power supply stage and an ac voltage output for driving said lamp;

wherein said electronic ballast includes a single controlled active switch shared between said dc-to-dc switching power supply stage and said dc-to-ac switching power supply stage; and wherein said first dc-to-dc switching power supply stage includes a coupling capacitor coupled in series between said dc voltage input of said dc-to-dc switching power supply stage and said storage capacitor, said coupling capacitor having a capacitance of less than half a capacitance of said storage capacitor.

2. An electronic ballast as claimed in claim 1 wherein said coupling capacitor has a capacitance of less than a tenth of a capacitance of said storage capacitor.

3. An electronic ballast as claimed in claim 1 wherein said controllable active switch is configured for control by a voltage referenced to a ground of said dc voltage input of said dc-to-dc switching power supply stage.

4. An electronic ballast as claimed in claim 1 wherein said controllable active switch comprises a transistor with one terminal substantially at a ground potential of said dc voltage input of said dc-to-dc switching power supply stage.

5. A mains power fluorescent lamp driver comprising the electronic ballast of claim 1, and including a rectifier circuit to provide a dc voltage for said dc-to-dc switching power supply stage from a rectified mains voltage.

6. A lighting controller for a gas discharge lamp, the lighting controller comprising:

a mains power supply input;

a mains rectifier circuit coupled to said mains power supply input and having a rectified mains voltage output;

a first inductor having an input side coupled to said rectified mains voltage output and an output side;

a controllable switch coupled in parallel between said output side of said first inductor and a ground connection of said rectified mains voltage output;

a coupling capacitor having an input side coupled to said output side of said first inductor and having an output side;

a second inductor coupled in parallel between said output side of said coupling capacitor and said ground connection;

a first rectifier coupled between said output side of said coupling capacitor and a storage capacitor to provide a dc voltage supply; and a pair of inductive elements each having a first connection coupled to said dc voltage supply and each having a second connection coupled to a respective rectifier; and an ac output circuit to drive said lamp coupled to said pair of inductive elements; and wherein a first of said respective rectifiers is coupled to said ground connection and a second of said respective rectifiers is coupled to said controllable switch.

7. A lighting controller as claimed in claim 6 wherein said first of said respective rectifiers is coupled to said ground connection via a second controllable switch.

8. A lighting controller as claimed in claim 6 further comprising a second rectifier coupled between said controllable switch and said coupling capacitor.

9. A light controller as claimed in claim 6 further comprising a controller coupled to said controllable switch and configured to provide a variable frequency oscillatory drive signal to control said controllable switch.

10. A light controller as claimed in claim 6 wherein said controllable switch comprises a bipolar transistor.

* * * * *